United States Patent [19]

Osseyran et al.

[11] Patent Number: 4,713,641

[45] Date of Patent: Dec. 15, 1987

[54] ELECTROMAGNETIC DEFLECTION UNIT

[75] Inventors: Anwar Osseyran; Jacobus J. M. Van De Meerakker, both of Eindhoven; Harmen Van Der Meulen, Veldhoven; Halbe Osinga, Eindhoven, all of Netherlands

[73] Assignee: U.S. Philips Corporation, New York, N.Y.

[21] Appl. No.: 32,421

[22] Filed: Mar. 30, 1987

[30] Foreign Application Priority Data

Apr. 14, 1986 [NL] Netherlands ..... 8600933

[51] Int. Cl.[4] ..... H01F 5/02

[52] U.S. Cl. ..... 335/213; 335/210

[58] Field of Search ..... 335/210, 213; 313/421, 313/426

[56] References Cited

U.S. PATENT DOCUMENTS 4,359,705 11/1982 Bohn et al. ..... 335/213

4,378,544 3/1983 Yabase et al. ..... 335/213 X 4,484,166 11/1984 Osinga et al. ..... 335/213

*Primary Examiner*—George Harris

*Attorney, Agent, or Firm*—Thomas A. Briody; Jack Oisher; William J. Streeter

[57] ABSTRACT

An electromagnetic deflection unit for a cathode ray tube, comprising has at least one support (4) with a flange (8) at its narrow end (5), which has a tangential groove into which merge radial grooves (14). Two sets of deflection coils (18, 19) are wound directly onto the support (4). The turns thereof traverse the radial grooves (14), the turns of at least one set of deflection coils (18) being bent into the tangential groove. The radial grooves (14) have longitudinally extending portions (16), which are filled by the turns traversing them. The bottom portion (20) of the tangential grooves lie on the surface of an oval cylinder. The deflection unit has a high sensitivity, large axial sliding tolerance and permits correction of various kinds of deflection errors.

1 Claim, 4 Drawing Figures

ELECTROMAGNETIC DEFLECTION UNIT

BACKGROUND OF THE INVENTION

1. Field of the Invention

The invention relates to an electromagnetic deflection unit for a cathode-ray tube, comprising: a hollow annular support provided with a narrow end and a wide end and with a longitudinal axis;

a respective flange at the narrow end and at the wide end of the support, these flanges each having at least one tangential groove with a bottom portion and each having a plurality of mainly radial grooves which merge into a said tangential groove and have at least in the flange at the narrow end a longitudinal extending portion having a width and a depth, which longitudinally extending portions are tangent to an inscribed circle;

a first set of deflection coils for line deflection of an electron beam in a first direction transverse to the longitudinal axis, these deflection coils being wound directly onto the support on the inner side thereof and the turns thereof each traversing the tangential groove and radial grooves of the flanges; and a second set of deflection coils for field deflection of an electron beam in a direction transverse to the longitudinal axis and transverse to the first direction, these deflection coils being wound directly onto the support and the turns thereof traversing radial grooves in the flanges.

Such a deflection unit is known from EP 0 No. 102 658 A1

2. Description of the Related Art

Cathode-ray tubes have a neck-shaped part, in one end of which an electron gun is arranged and the other end of which passes into a conical part, which is joined by a screen. An electromagnetic deflection unit is arranged around the neck-shaped part and against the conical part or at a short distance therefrom. This deflection unit has to be able to deflect electron beams also to the corners of the screen. Therefore, these beams must be prevented from touching on their way to the screen the inner wall of the tube, as otherwise they would be reflected and would reach the screen elsewhere. These undesired reflections can be avoided if the deflection unit is situated sufficiently close to the screen of the tube. However variations in the outer dimension of the conical part of the tube and in the inner dimension of the deflection unit can result in that the deflection unit can be displaced over a smaller distance towards the screen than was expected. Also in this case, it must be possible that the electron beams are correctly deflected to the corners of the screen.

Therefore, it is of great importance that the design disign of a deflection unit provide a large distance between a foremost position of the deflection unit, in which this unit abuts against the conical part of the tube and a correct deflection takes place, and a hindmost position, more remote from the screen of the tube, in which a reflection of electron beam on their way to corners of the screen must not take place. In other words: the deflection unit must have a large axial sliding tolerance. It has been found that the known deflection unit has a comparatively small axial sliding tolerance. A large axial sliding tolerance is also of importance in order to neutralize, for example, variations in the properties of the electron gun.

The design of a deflection unit can also lead to errors of different nature, such as raster errors, astigmatic errors and coma errors. These errors can be corrected by different means. Coma errors can be corrected most effectively by adaptation of those parts of the deflection unit which are located at the narrow end of the support close to the electron gun. Areas more remote from the electron gun can then be employed for correction of other errors. The possibilities for correction of errors are therefore greater when the deflection unit extends in closer proximity of the electron gun. However, this has the disadvantage that the deflection unit begins to deflect electron beams already in the proximity of the electron gun, as a result of which the risk of collisions with the wall of the tube and undesired reflections increases. The axial sliding tolerance of the deflection unit is therefore smaller in a unit which extends in closer proximity of the electron gun.

SUMMARY OF THE INVENTION

The invention has for its object to provide a deflection unit of a construction which permits of obtaining a larger axial sliding tolerance, as well as greater possibilities for correction of errors.

In a deflection unit according to the invention, this object is achieved in that in the flange at the narrow end of the support the width and the depth of the longitudinally extending portion of each of the radial grooves are chosen so that the turns traversing these grooves substantially fill these portions, and the bottom portion of the said at least one tangential groove is located on the surface of an oval cylinder.

In the deflection unit according to the aforementioned EP O No. 102 658 A1, the flange at the narrow end of the support is formed so that the longitudinally extending portions of the radial grooves are tangent to an inscribed circle so as to surround tightly the neck of a cathode-ray tube, but these portions all have the same depth and at least substantially the same width (cf. FIGS. 6, 12). Depending upon the number of turns in a groove, this longitudinally extending portion of a groove is consequently filled to a greater or smaller extent. In the unit according to the invention, the width and the depth of the longitudinally extending portions of the radial grooves are chosen so that the turns traversing these parts substantially fill these parts. As a result, turns in situ are located closer to the longitudinal axis of the deflection unit. The sensitivity of the deflection unit is thus improved. In a favourable embodiment, the depth of the longitudinally extending portions of the grooves is minimized in favour of the width.

The measure mentioned in the preceding paragraph results in that the flange has longitudinally extending groove portions, whose depth may vary from groove to groove, so that their bottom portions are not located on a circle, but rather on an oval.

The smaller depth of most of the longitudinally extending groove portions renders it possible to locally displace accordingly the bottom portion of the tangential groove inwardly, as a result of which this bottom portion becomes located on an oval. In the deflection unit according to the aforementioned EP O No. 102 658 A1, the bottom portion of the transverse groove is on the contrary tangent to a circle (cf. FIGS. 6 and 12).

It has been found that in a deflection unit which was otherwise left unchanged, such an inward displacement of two points of the tangential groove located diametrically opposite to each other over a distance of each 3 mm in order to deform the groove to an oval groove (within the original circular path), resulted in an enlargement of the axial sliding tolerance of the deflection unit by 1 mm. The axial sliding tolerance then increased from 3.8 to 4.8 mm, which is a substantial increase. In this unit, a further inward displacement over the same distance resulted in a further increase of well over 1 mm.

In order to obtain the largest possible effect, it is useful to make the oval cylinder on whose surface the bottom portion of the tangential groove is disposed as small as possible, that is to say to minimize the radii of curvature of the said oval cylinder. As a result, the turns of the coils in this tangential groove consequently get as close as possible to the longitudinal axis of the deflection unit. The possibilities to make this oval cylinder smaller are limited by the mechanical strength the flange must have to be capable of withstanding the inwardly directed force exerted by the turns. At the area at which many turns coming from a given radial groove are passed into the tangential groove, a comparatively large force is exerted on the bottom portion of this tangential groove so that it becomes necessary that at this area the flange has a comparatively great strength and the tangential groove has a comparatively thick wall of the bottom portion. The oval shape of the bottom portion of the tangential groove is strongly influenced thereby.

The enlargement of the axial sliding tolerance may be utilized as such. Alternatively, the effect of the measures in the deflection unit according to the invention may be utilized entirely or in part to lengthen the unit towards the electron gun of a cathode-ray tube, with which the unit is used. Thus, the possibility is increased to prevent coma errors and the other errors. The deflection unit according to the invention has a higher sensitivity due to its higher filling degree (consumes less energy). The measures taken in accordance with the invention further permit of shortening the unit at its wide end.

The annular support of the deflection unit according to the invention may be a body of synthetic material provided with flanges of synthetic material in or around which a yoke ring of soft magnetic material is arranged. Alternatively, a yoke ring may itself act as a support and may be connected at its narrow end and at its wide end to a respective flange of synthetic material. Both sets of deflection coils may be of the saddle type or one set may be of the saddle type and one set of the toroidal type. The flange at the narrow end may have a tangential groove for each of the sets of deflection coils or one groove for both sets together or more than two tangential grooves, such as, for example, one for one set of deflection coils and two for the other set or one for each set separately and one for both sets together.

BRIEF DESCRIPTION OF THE DRAWINGS

An embodiment of the deflection unit according to the invention is shown in the drawings. In the drawings.

DESCRIPTION OF THE PREFERRED EMBODIMENTS

Figure 1:
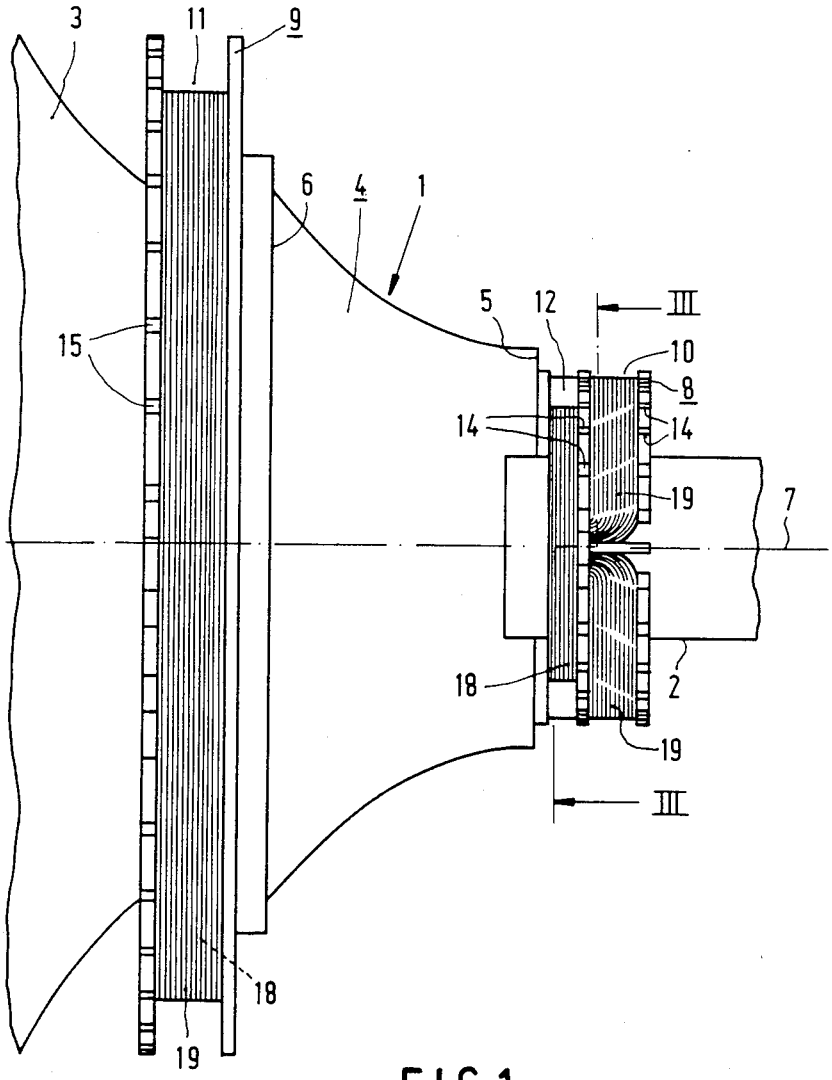
FIG. 1 is a side elevation of a deflection unit arranged around the neck-shaped part of a cathode-ray tube.

In FIG. 1, the electromagnetic deflection unit 1 is arranged around the neck-shaped part 2 of a cathode-ray tube, of which the conical part is designated by reference numeral 3. The deflection unit 1 has a hollow annular support 4 provided with a narrow end and a wide end 5 and 6, respectively, and with a longitudinal axis 7. In the Figure, the support 4 is a yoke ring of soft magnetic material. The support 4 has flanges 8 and 9, respectively, of translucent polycarbonate at the narrow end and the wide end 5 and 6, respectively. The flanges 8,9 each have at least one tangential groove 10,11 with a bottom portion (20 in FIG. 4) and a plurality of mainly radial grooves 14,15 merging into the tangential grooves 10,11. In the Figure, the flange 8 has a second tangential groove 12. In the flange 8 at the narrow end 5, the radial grooves 14 have a longitudinally extending portion (16, FIG. 4) having a width and a depth, which longitudinal extending portions (16) are tangent to an inscribed circle (17, FIG. 3).

A first set of deflection coils 18 for line deflection of an electron beam in a first direction transverse to the longitudinal axis 7 (that is to say: in the plane of the drawing) is wound directly onto the support 4 on the inner side thereof. The turns of the set of coils 18 each traverse the tangential groove 12 and 11, respectively, of the flanges 8 and 9, respectively, and radial grooves 14 and 15, respectively, thereof.

A second set of deflection coils 19 for field deflection of an electron beam in a direction transverse to the longitudinal axis 7 and transverse to the first direction (that is to say, at right angles to the plane of the drawing is also wound directly onto the support and its turns traverse radial grooves 14,15 in the flanges 8,9. In the Figure, both sets of deflection coils 18,19 are of the saddle type. The second set of deflection coils 19 is also arranged on the inner side of the support 4 and its turns also traverse tangential grooves 10 and 11, respectively. in the flanges 8 and 9, respectively. The first set of deflection coils 18 is wound first. In the Figure its turns traverse the same groove 11 in the flange 9 as the turns of the second set of deflection coils 19 and consequently below (not visible) the turns of the second set 19. In the flange 8, the turns of the first (18) and the second (19) set of deflection coils have their individual tangential groove 12 and 10, respectively. The deflection unit of FIG. 1 has the features of the deflection unit according to the invention. These features are explained with reference to FIGS. 2, 3 and 4. As far as parts of these Figures are shown in FIG. 1, they have the same reference numerals.

Figure 2:
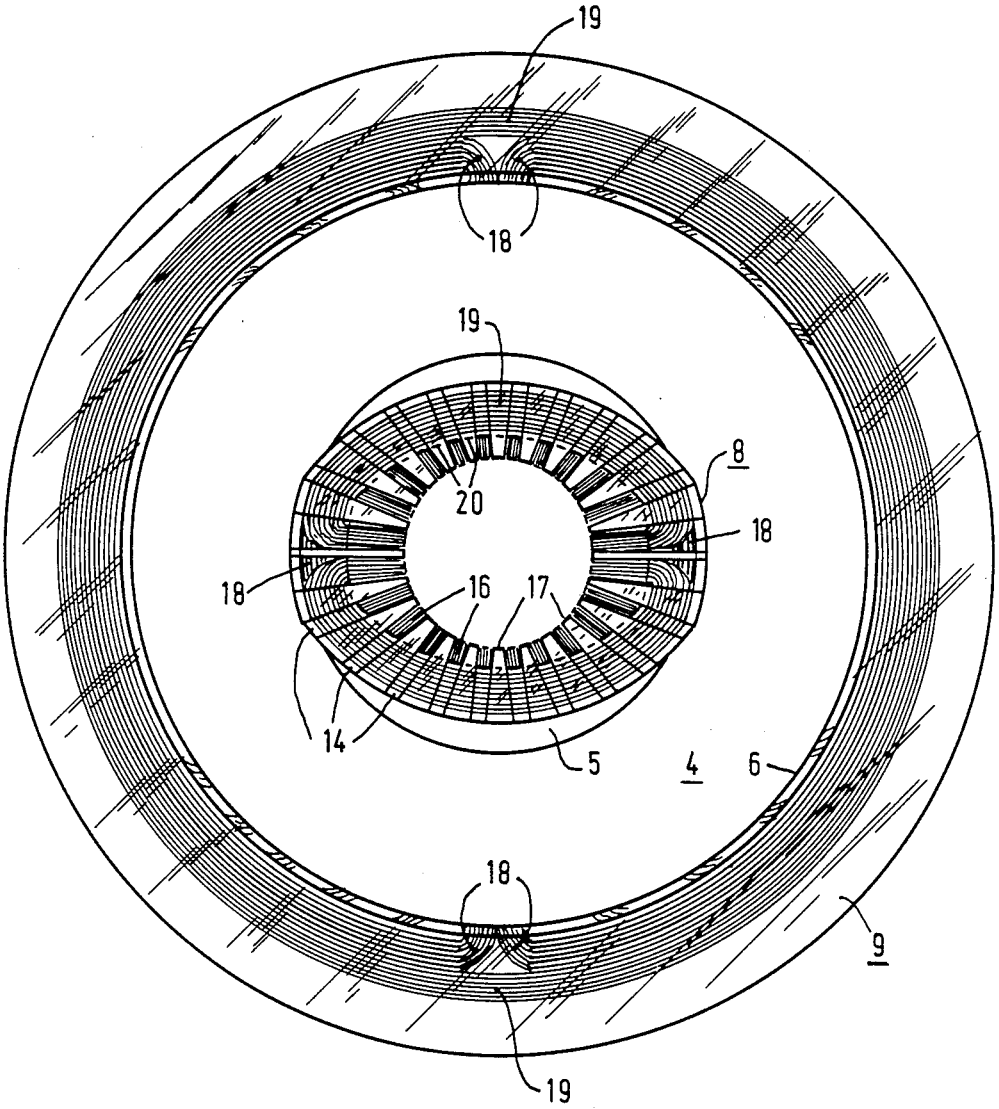
FIG. 2 is a rear view of the deflection unit shown in FIG. 1.
Figure 3:
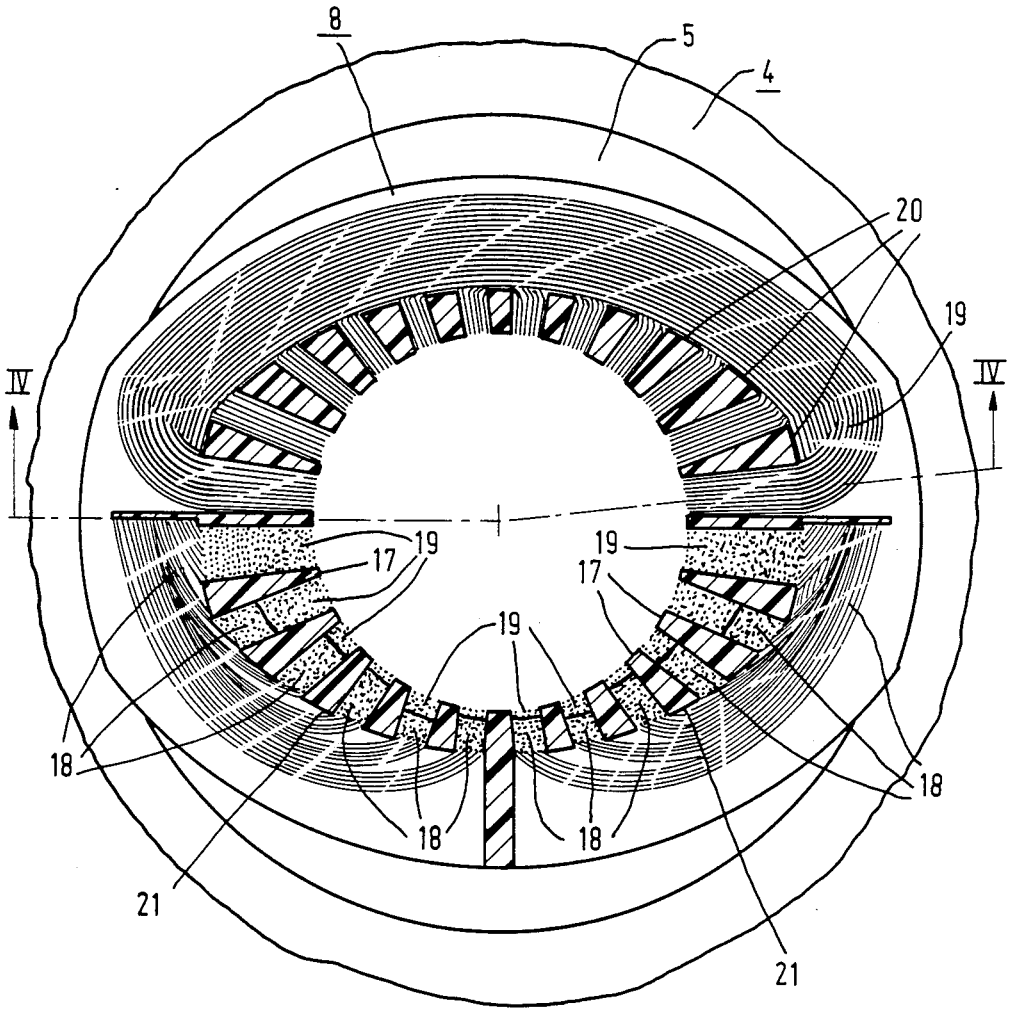
FIG. 3 is a sectional view taken on the line III—III in FIG. 1.

FIGS. 2, 3 illustrate that the radial grooves 14 in the flange 8 at the narrow end 5 of the support 4 are tangent to an inscribed circle 17 with their longitudinally extending portions 16. The width and the depth of these parts 16 are chosen so that the turns of the sets of deflection coils 18,19 traversing these grooves substantially fill these portions 16. The inner turns are consequently tangent to said inscribed circle 17. The bottom portions 20 and 21, respectively, of the tangential grooves 10 and 12, respectively, are located on a oval cylinder.

Figure 4:
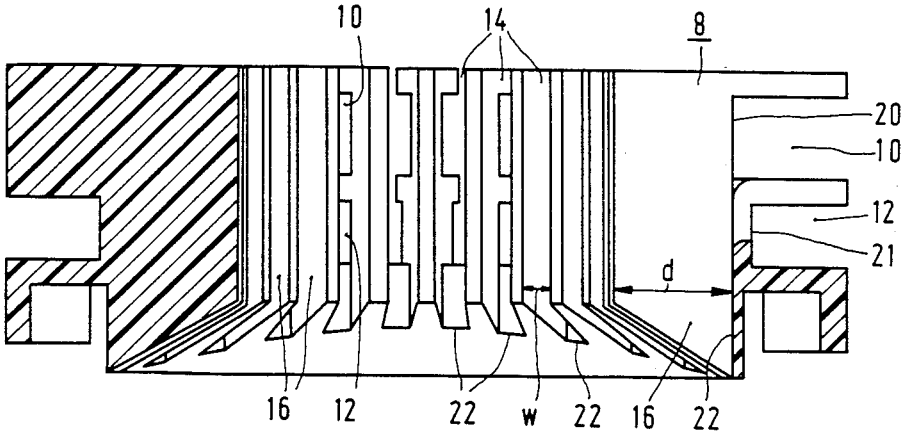
FIG. 4 is an axial sectional view taken on the line IV—IV in FIG. 3.

In FIG. 4, the mainly radially extending grooves 14 which merge into tangential grooves 10,12 have a longitudinally extending portion 16. These portions 16 each have a width w and a depth d. The bottom portions of the tangential grooves 10,12 are designated by reference numerals 20 and 21, respectively. The bottom portions 22 of the longitudinally extending portions 16 are tangent to an oval (cf. FIG. 3).

The walls of the bottom portions 20 and 22 of the tangential grooves 10 and 12, respectively, are thicker (FIG. 3) at the area at which many turns of the deflection coils 18,19 coming from a radial groove (14, FIG. 2) are bent into a tangential groove 10,12 (on the lefthand and the righthand side in the Figure). The distance between these bottom portions 20,21 and the inscribed circle 17 is then large. The oval cylinder on whose surface the bottom portions 20, 21 are located has therefore its largest traverse dimension in horizontal direction in the Figure.

What is claimed is:

1. An improved electromagnetic deflection unit for a cathode-ray tube, such deflection unit comprising:

a hollow annular support provided with a narrow end and a wide end and with a longitudinal axis;

respective flanges at the narrow end and the wide end of the support, each flange having at least one tangential groove with a bottom portion and a plurality of mainly radial grooves merging into a said tangential groove, the radial grooves in at least the flange at the narrow end each having a longitudinally extending portion of predetermined width and depth, which longitudinally extending portions are tangent to an inscribed circle;

a first set of deflection coils for line deflection of an electron beam in a first direction transverse to said longitudinal axis, such deflection coils being wound directly onto said support on the inner surface thereof and the turns thereof traversing each of the tangential grooves and radial grooves of the flanges; and a second set of deflection coils for field deflection of said electron beam in a second direction traverse to said longitudinal axis and transverse to said first direction, such deflection coils being wound directly onto the support and the turns thereof traversing said radial grooves in the flange, said improvement being characterized in that in the flange at the narrow end of said support:

the width and the depth of said longitudinally extending portion of each of said radial grooves are chosen so that the turns traversing these grooves substantially fill such portions of said grooves; and said bottom portions of said tangential grooves are located on the surface of an oval cylinder.

* * * * *